US005454122A

United States Patent [19]

Bergeron

[11] Patent Number: 5,454,122

[45] Date of Patent: Oct. 3, 1995

[54] TOILET VENTILATOR WITH ROOM AIR FRESHENER AND COMFORT HEATER

[76] Inventor: Donald J. Bergeron, 3750 Tamayo St., Apt. 146, Fremont, Calif. 94536

[21] Appl. No.: 231,249

[22] Filed: Apr. 22, 1994

[51] Int. Cl.[6] ..... E03D 9/052

[52] U.S. Cl. ..... 4/217; 4/213

[58] Field of Search ..... 4/213, 217, 420.2, 4/DIG. 6

[56] References Cited

U.S. PATENT DOCUMENTS

| | | | |
|---|---|---|---|
| 2,847,682 | 8/1958 | Shay | 4/213 |
| 2,849,727 | 9/1958 | Bollinger et al. | 4/217 |
| 3,069,696 | 12/1962 | Howell | 4/213 |
| 3,230,551 | 1/1966 | Kopp | 4/213 |
| 3,491,382 | 1/1970 | Poister | 4/217 |
| 3,571,824 | 3/1971 | Poister | 4/213 |
| 3,857,119 | 12/1974 | Hunnicutt, Jr. | 4/213 |
| 3,938,201 | 2/1976 | McGrew | 4/213 |
| 4,007,498 | 2/1977 | Pearson | 4/213 |
| 4,017,916 | 4/1977 | Pearson | 4/213 |
| 4,087,871 | 5/1978 | Benthin | 4/217 |
| 4,103,370 | 8/1978 | Arnold | 4/213 |
| 4,433,441 | 2/1984 | Schroeder | 4/213 |
| 4,558,473 | 12/1985 | Morikawa et al. | 4/213 X |
| 4,620,329 | 11/1986 | Wix | 4/217 |
| 4,653,126 | 3/1987 | Morandi et al. | 4/420.2 |
| 4,701,966 | 10/1987 | Schafer | 4/213 |
| 5,161,262 | 11/1992 | Quaintance, Sr. | 4/213 |
| 5,231,705 | 8/1993 | Ragusa | 4/213 |
| 5,345,617 | 9/1994 | Jahner et al. | 4/217 |

*Primary Examiner*—Robert M. Fetsuga
*Attorney, Agent, or Firm*—James J. Leary; Carol A. Duffield

[57] ABSTRACT

A toilet ventilation system which ventilates the air within the bowl of a water closet, deodorizes it, adds air freshener and returns it to the toilet bowl. The system may also serves as a room air freshener and/or a comfort heater for warming the air within the toilet bowl. The system may be equipped to run on AC, DC, or both. The system has four interconnecting modules: a) a ventilator module located beneath the toilet seat, b) a central module which contains the ductwork to connect all of the other modules and the control panel for operating all of the functions of the system, c) a main blower module which contains the centrifugal fan which recirculates the air and filters which deodorize and add fragrance to the air, and d) a heater module which contains an air heater and a centrifugal fan for warming the air beneath the toilet seat.

14 Claims, 11 Drawing Sheets

TOILET VENTILATOR WITH ROOM AIR FRESHENER AND COMFORT HEATER

FIELD OF THE INVENTION

The present invention relates to an improved toilet ventilator system. More particularly, it relates to a deodorizing and recirculating toilet ventilator system which also fulfills the functions of a room air freshener and a comfort heater.

BACKGROUND OF THE INVENTION

Objectionable bathroom odor is of particular concern to many people. A great deal of inventive energy has been expended in the pursuit of eliminating bathroom odors. Despite the efforts spent on solving this problem which is as old as the advent of indoor plumbing, the present inventor finds the prior art solutions to be lacking in several important aspects.

The preponderance of the prior art toilet ventilators use the approach of gathering the odoriferous gasses from the space within the toilet bowl and exhausting these gases to the exterior of the building. Such systems are described in U.S. Pat. Nos. 2,847,682; 3,069,696; 3,938,201; 4,007,498; 4,017,916; 4,103,370; 4,620,329; and 4,701,966. While this exterior ventilation approach may be effective at eliminating odors in a brute-force manner, it is highly inefficient from the viewpoint of energy conservation. If such a system is used in a heated or air conditioned bathroom, the air which comes in to make up for the exhausted air must be heated or cooled at the expense of considerable energy.

Another common prior art approach attempts to overcome the energy inefficiency of exterior exhaust systems by removing the odor containing air from within the toilet bowl, filtering it or adding fragrance and exhausting the air within the interior of the bathroom. Systems using this approach are described in U.S. Pat. Nos. 3,230,551; 3,491,382; 3,571,824; 3,857,119; and 5,161,262. This approach may eliminate the wasted energy of exterior exhaust systems by returning the air to the room, but the approach is ultimately self defeating. No matter how effective the filtering or fragrance system is, it cannot remove all of the odor causing agents from the air and the fact remains that the system is taking odor ridden air from within the toilet bowl, partially removing the effluents, and exhausting it to the bathroom atmosphere where it is far more likely to be breathed in by the occupants of the bathroom. This disadvantage may become even more noticeable as the filter element nears the end of its useful life. A saturated filter may actually begin to return absorbed odors to the room air, exacerbating the odor problem rather than curing it.

In order to eliminate the energy inefficiency of exterior exhaust systems and the self-defeating nature of interior exhaust systems, the present invention uses a recirculation approach which draws air from within the toilet bowl, filters out odors, adds a fragrance, then returns the air to the toilet bowl, not to the room. This closed-system recirculating approach is highly effective and highly energy efficient. Only one prior art patent has been found that attempts to use a recirculation approach. This patent, U.S. Pat. No. 4,433,441, however, has only one mode of operation and lacks many of the other features important to the present invention, such as a room air freshening function and a comfort heater.

Another related area of technology includes toilets or toilet attachments for washing and drying the occupant after use of the toilet. This technology is exemplified in U.S. Pat. Nos. 4,087,871 and 4,653,126. These patents are mentioned because they both include a heated air source which blows hot air into the toilet bowl interior to dry the user. This approach should not be confused with the comfort heater function of the present invention. The hot air blowers in these prior art patents create a positive pressure inside the toilet bowl which would disperse the odor filled air from within the toilet bowl, exacerbating any odor problem rather than solving it.

SUMMARY OF THE INVENTION

In keeping with the foregoing discussion, a primary objective of the present invention is to provide a toilet ventilation system which will ventilate the air within the bowl of a water closet, deodorize it and return it to the toilet bowl. It is another objective to provide a toilet ventilation system which adds a fragrance to the ventilated air before recirculating it to the toilet bowl. It is a further objective to provide a toilet ventilation system which also serves as a room air freshener for deodorizing and adding a fragrance to the air within the bathroom. It is also an objective of the invention to provide a comfort heater for warming the air within the toilet bowl for the comfort of the user at cold times.

It is also an objective of the invention to provide a toilet ventilation system with multiple modes of operation. One aspect of this is to provide a toilet ventilation system with both automatic and manual operating modes and with a timed mode for unsupervised operation. Another aspect is to provide a toilet ventilation system which can be operated on battery power or on AC power or on a combination of battery and AC power. An important aspect of this is to provide electrical isolation to the system which will prevent any possible injury to the user whenever the system is connected to AC power. Another aspect is to provide a toilet ventilation system with multiple modes of operation which can be used separately or in combination for toilet ventilation, room deodorizing and comfort heating.

Another objective of the invention is to provide all of the listed objectives and functions in a unit which blends aesthetically with a standard or custom designer toilet. The unit should be easily installable as new equipment at the factory or as a retrofit by the homeowner without special tools or the need to hire a plumber or electrician.

In accordance with these objectives, the present invention takes the form of a toilet ventilation system that has four interconnecting modules: a) a ventilator module which is integral with the seat of a toilet and contains ductwork and vents to circulate the air within the toilet bowl and into the bathroom (the ventilator module may also be made as a retrofit that would fit beneath the toilet seat already in place), b) a central module which contains the intricate ductwork to connect all of the other modules and the control panel for operating all of the functions of the system, c) a main blower module which contains the centrifugal fan which recirculates the air and filters which deodorize and add fragrance to the air, and d) a heater module which contains an air heater and a centrifugal fan for warming the air beneath the toilet seat. Each module is small enough to be easily handled and installed by the consumer and simple interconnections allow the entire system to be easily assembled onto an existing toilet. Other objects and advantages of the invention will no doubt occur to those skilled in the art upon reading and understanding the following detailed description along with the accompanying drawings.

DETAILED DESCRIPTION OF THE INVENTION

Figure 1:
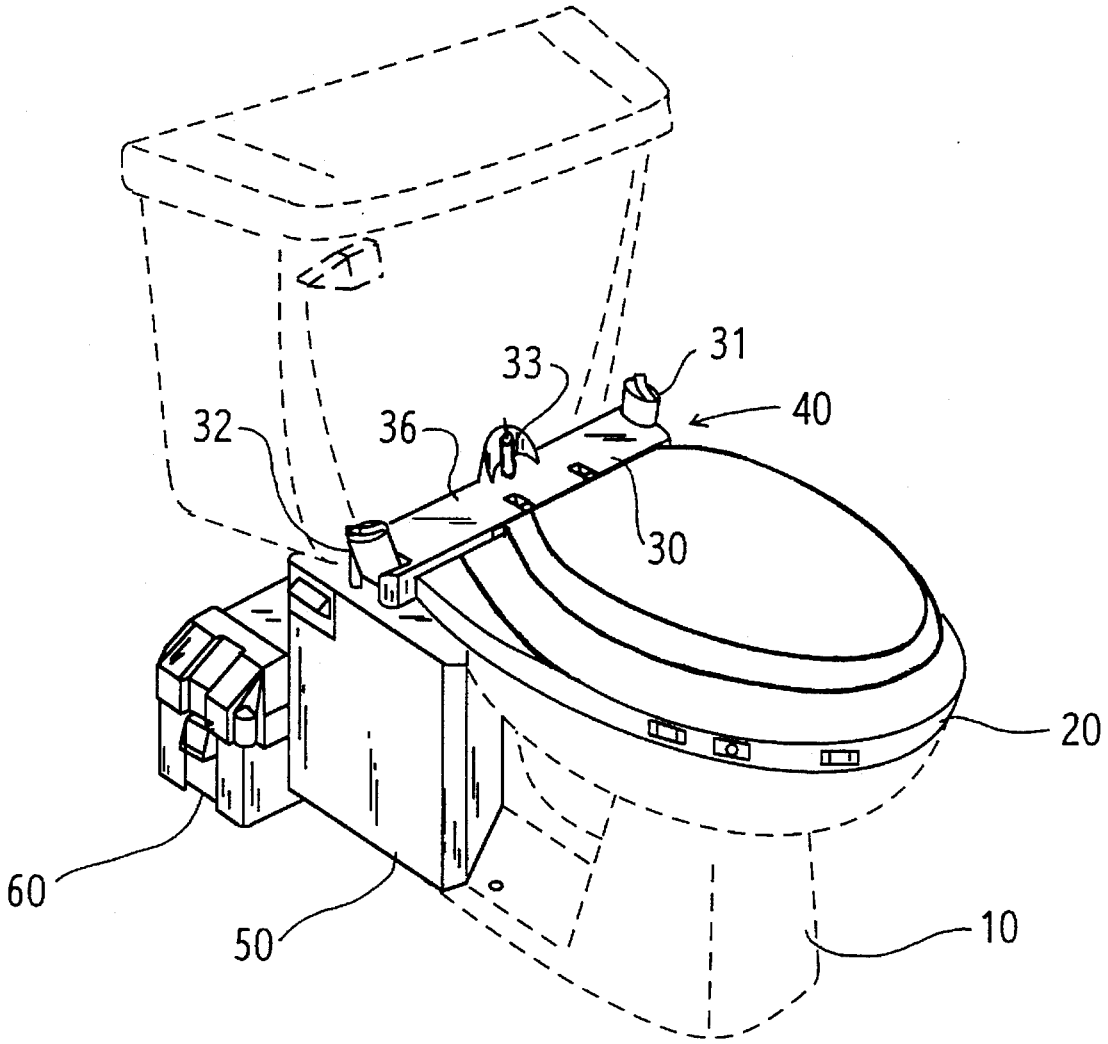
FIG. 1 shows the toilet ventilation system installed on a standard toilet.

For the sake of convenience and to avoid possible confusion all directional references, e.g. left, right, forward, rearward, etc., in the following description are given from the point of view of a user seated on the toilet. Inasmuch as possible the drawing figures have been arranged to respect this convention.

FIG. 1 shows the toilet ventilation system of the present invention installed on a standard toilet 10. The system is made up of four modules: the ventilator module 20, the central module 30, the main blower module 40 (not shown) and the heater module 50. Also seen is the optional battery module 60. Each module is small enough to be easily handled and installed by the consumer and simple interconnections allow the entire system to be easily assembled onto an existing toilet. Making the system in separable modules also allows a sleeker and more space-saving design than would be possible if it was made as a single unit. The main blower module 40 and the heater module 50 are made to be form-fitting to the sides of the toilet, fitting into the recesses to the rear and below the rim of the toilet bowl. If the system was made as a solid unit, interferences would not allow the modules to be installed into these recesses. This aspect allows the ventilation system to be designed so that it blends aesthetically with the original design of the toilet, making it look more like original equipment than an add-on. The casing of each module of the ventilation system can be molded in plastic so that it is durable and easy to clean. The plastic can be color compounded to match the color of a standard toilet or in more exotic colors for designer toilets or it can be colored to contrast with the color of the toilet for a different aesthetic appeal.

Figure 6A:
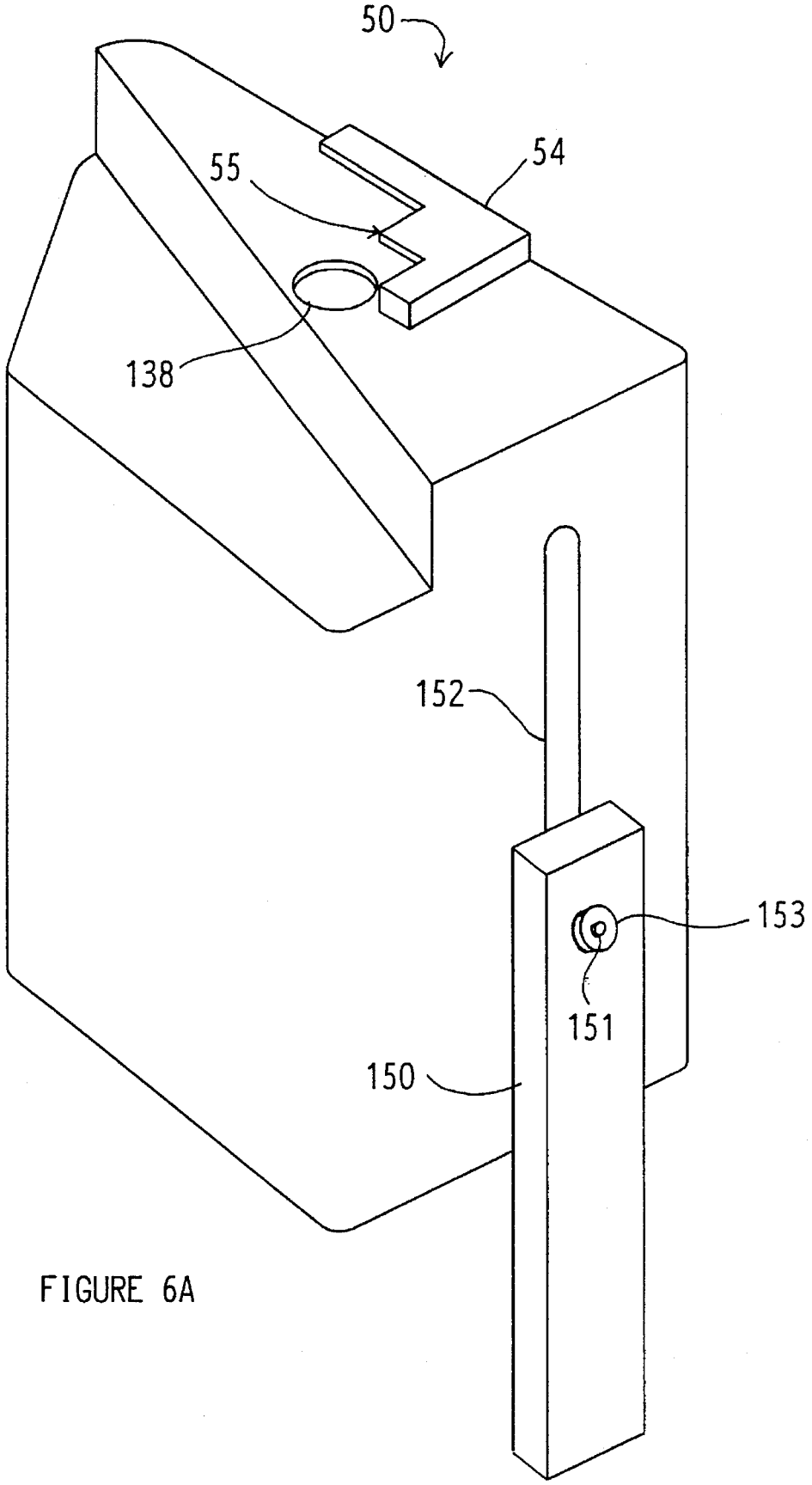
FIGS. 6A & B show the heater module of the system.

The main blower module 40 and the heater module 50 may be made with adjustable legs to support the weight of the modules in cases where the casing materials do not provide sufficient support. FIG. 6A shows the rear view of the heater module 50 with the optional support leg 150. The support leg 150 attaches to the rear of the heater module housing 50 by a bolt 151 which rides up and down in a slot 152 in the housing 50. The support leg 150 can be extended to the floor to support the weight of the module 50 and locked into place by tightening the locking nut 153 on the bolt 151.

Figure 2:
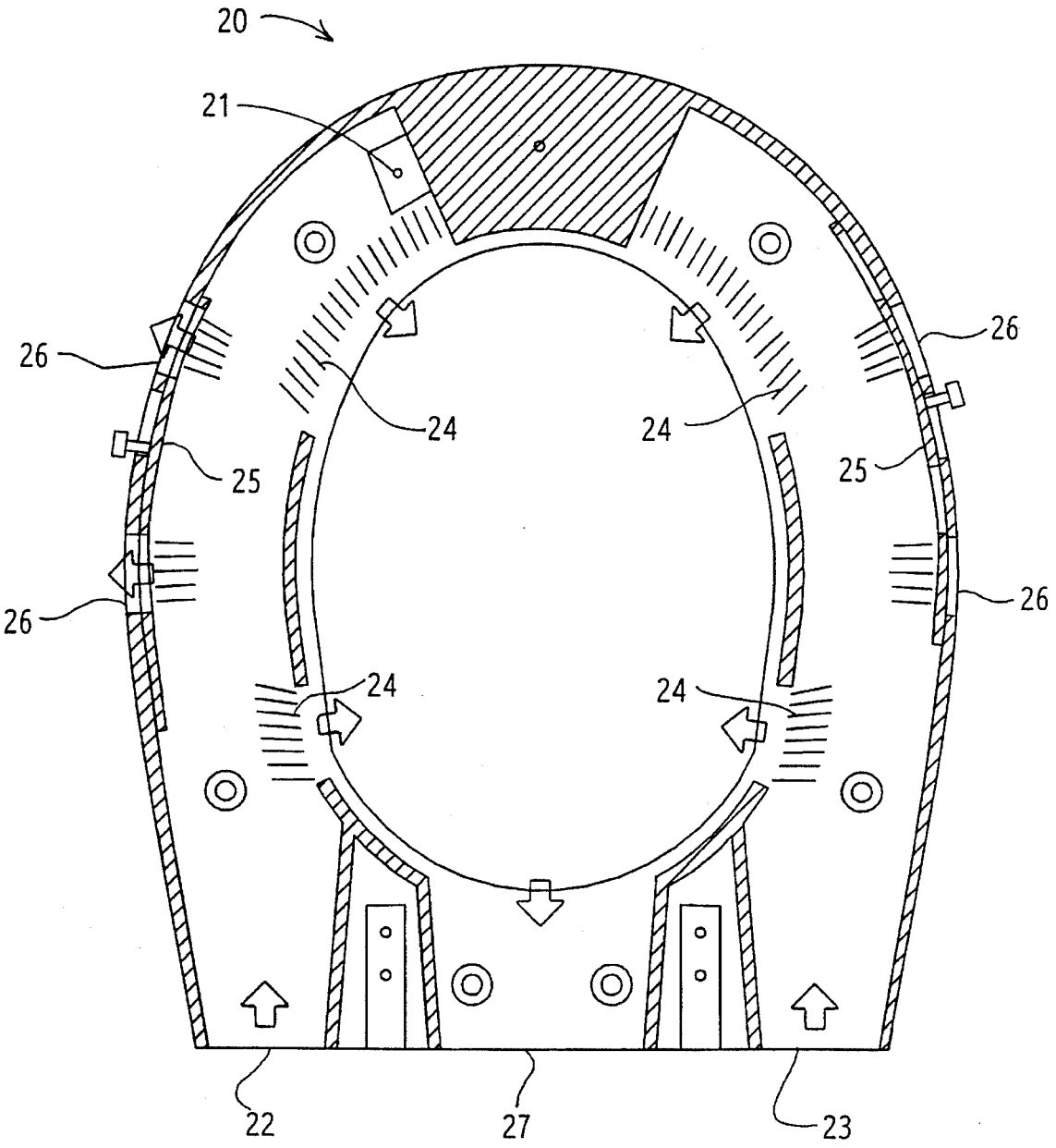
FIG. 2 shows a cutaway view of the ventilator module showing the air flow pattern.

FIG. 2 shows the ventilator module 20 of the toilet ventilation system. The ventilator module 20 is made integral with the seat of the toilet. Since the ventilator module 20 is a part of the toilet seat, when the seat lifts up, the ventilator module 20 is lifted with it. This is an advantage over some of the prior art toilet ventilators where the ventilator ducting is permanently installed on the top rim of the toilet bowl, restricting access to the bowl for thorough cleaning, and where it is always in the line of fire, so to speak, making it more likely to become soiled. The rear of the ventilator module 20 abuts the central module 30 making a fluid connection between the two when the seat is down. When the seat is raised, the ventilator module 20 is disconnected from the central module 30 allowing air to flow directly from the central module 30 into the surrounding atmosphere.

The ventilator module 20 is made with a pressure switch 21 on the underside of the module. The pressure switch 21 is a momentary switch which is normally in the off position. Plastic foam or another resilient material surrounds the switch acting as a spring member. When the weight of a person seated on the toilet presses down on the toilet seat with the ventilator module 20 attached to it, the switch 21 is depressed, moving it to the on position and activating the main blower motor 41.

FIG. 2 is a cutaway internal view of the ventilator module 20 which shows the flow path of air through the module. Filtered, scented air enters the air inlets 22, 23 on both sides of the ventilator module 20 from the central module 30 and flows forward and out through the louvred interior vents 24. The louvres in the interior vents 24 are specially constructed to direct the airflow rearward through the toilet bowl toward the exhaust duct 27. If it is desired to vent some of the fragrant air out into the atmosphere of the bathroom, the sliding shutters 25 can be opened to allow some of the air to flow out through the louvred external vents 26. For illustrative purposes, FIG. 2 is shown with the sliding shutters 25 on the left hand side of the ventilator module 20 opened to allow air to flow out through the louvred external vents 26 and with the sliding shutters 25 on the right hand side of the ventilator module 20 closed to prevent air from flowing out through the louvred external vents 26. Air inside the enclosure of the toilet bowl is gathered into the exhaust duct 27 by the suction of the main blower fan 41.

The system control panel which is part of the central module 30 can be seen in FIG. 1. The central module 30 has a main blower switch 31, a heater switch 32 and a timer switch 33. The main blower switch 31 and the heater switch 32 change the system over to manual operation mode, turning on the main blower motor 41 and the heater module 50, respectively. The timer switch 33 can be a dashpot-type time delay switch or a mechanical or electrical timer switch.

Figure 3C:
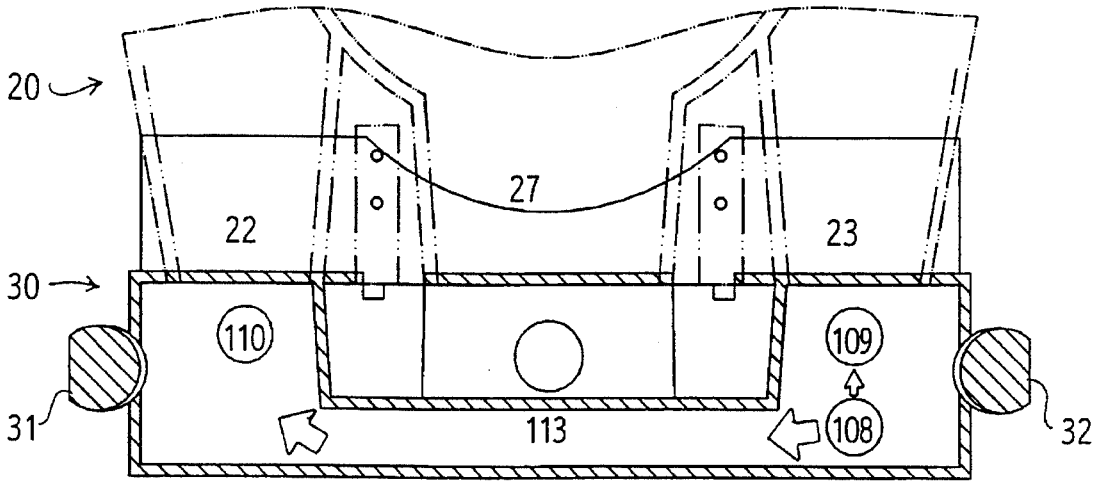
FIGS. 3A, B & C show the internal air ducts and the air flow pattern in the central module.
Figure 3B:
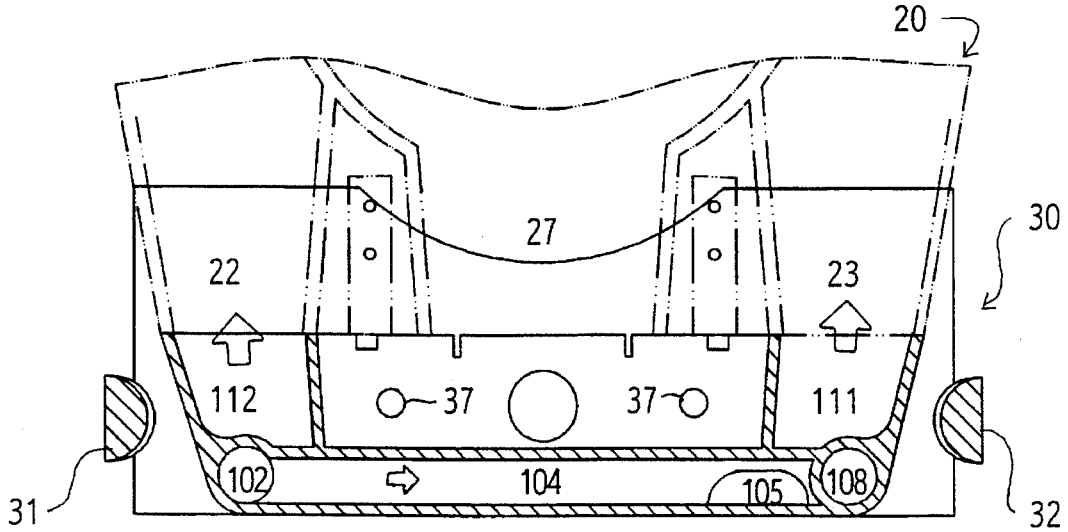
Figure 3A:
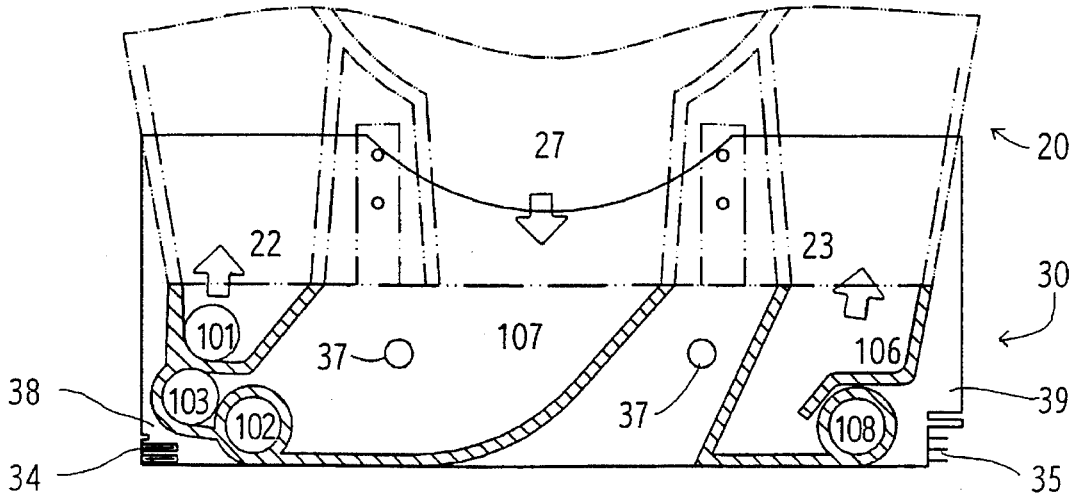

FIGS. 3A, 3B and 3C together represent an exploded view of the central module 30 showing the internal air ducts. The central module 30 has three stacked layers with air ducts that interconnect between the layers. The three layers will be referred to by their respective figure numbers 3A, 3B, 3C. The three separate layers 3A, 3B and 3C containing the ductwork and the cover 36 (seen in FIG. 1) stack together to complete the central module 30. Filtered and scented air from the main blower 42 enters the central module 30 through two inlet ports 101, 102. The first inlet port 101 connects with the first layer 3A of the central module 30 where the air is directed into the air inlet 22 on the left side of the ventilator module 20. The second inlet port 102 passes through the first layer 3A and connects with the second layer 3B of the central module 30 which has a crossover duct 104 with a connection port 105 that connects with an outlet port 106 on the first layer 3A on the right side of the central module 30. The air passes from the connection port 105 to the outlet port 106 on the first layer 3A and into the air inlet 23 on the right side of the ventilator module 20. The exhaust duct 27 of the ventilator module 20 connects to the central duct 107 on first layer 3A of the central module 30 which is connected to a suction port 103 leading to the suction side of the main blower 42.

The outlet of the heater module 50 is connected to a hot air inlet port 108 on the right hand side of the central module 30. The hot air inlet port 108 passes through the first layer 3A and the second layer 3B and connects with the third layer 3C of the central module 30. The air from the hot air inlet port 108 is divided so that some of the air is directed downward through a connection port 109 to the hot air outlet port 111 on the right hand side of the second layer 3B which connects with the right air inlet 23 of the ventilator module 20. The remainder of the air is directed through a crossover duct 113 to the left side of the third layer 3C where it enters a second connection port 110 which leads to the hot air outlet port 112 on the left hand side of the second layer 3B, which then connects with the left air inlet 22 of the ventilator module 20.

The central module 30 is made with a sliding connector 38 on the left hand side that is made to connect with the main blower module 40. The sliding connector 38 includes a female electrical connector 34 that accepts a two-prong male connector. The central module 30 also has a second sliding connector 39 on the right hand side that is made to connect with the heater module 50. This sliding connector 39 also includes a female electrical connector 35 that accepts a three-prong male connector.

Figure 4A:
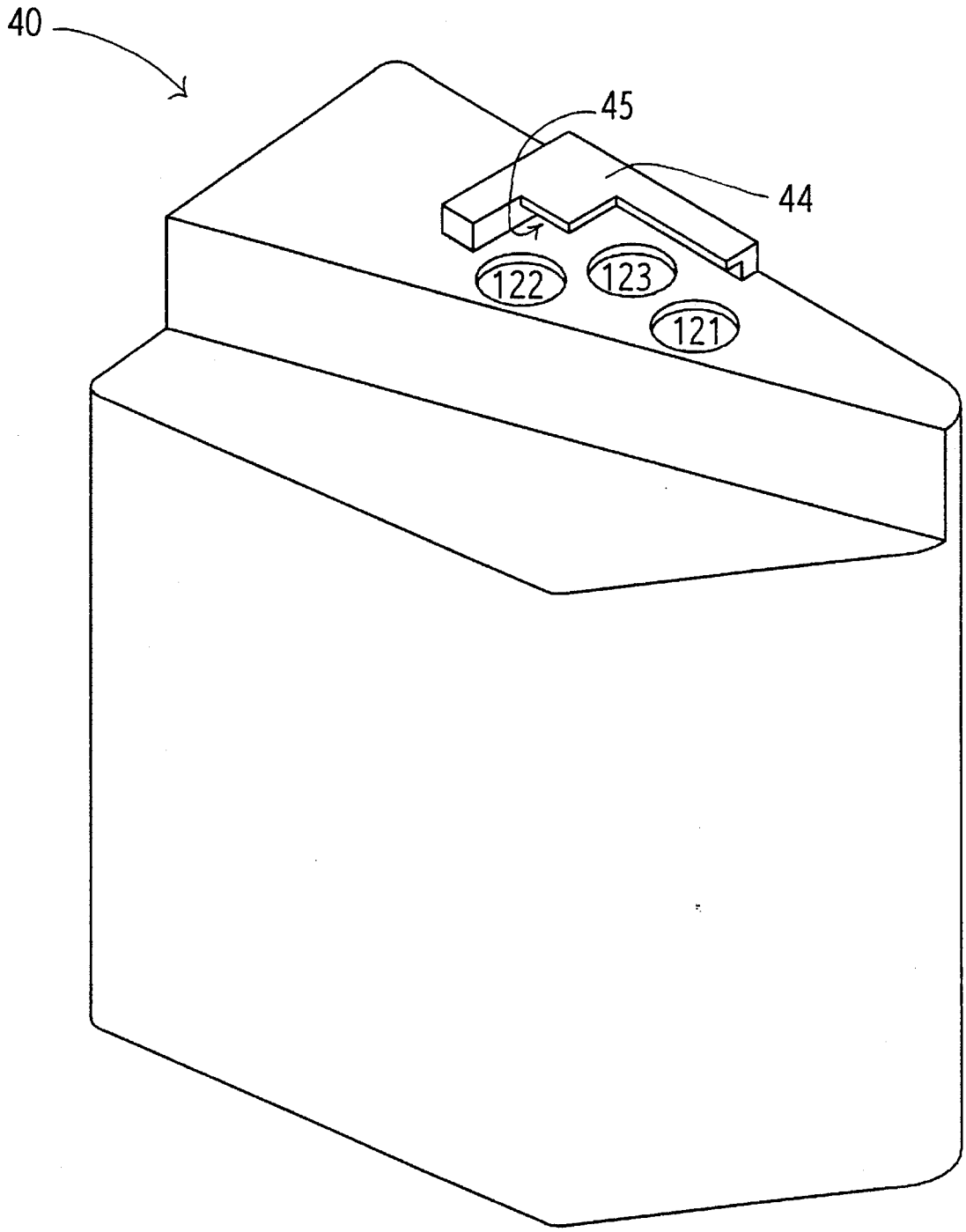
FIGS. 4A & B show the main blower module of the system.
Figure 4B:
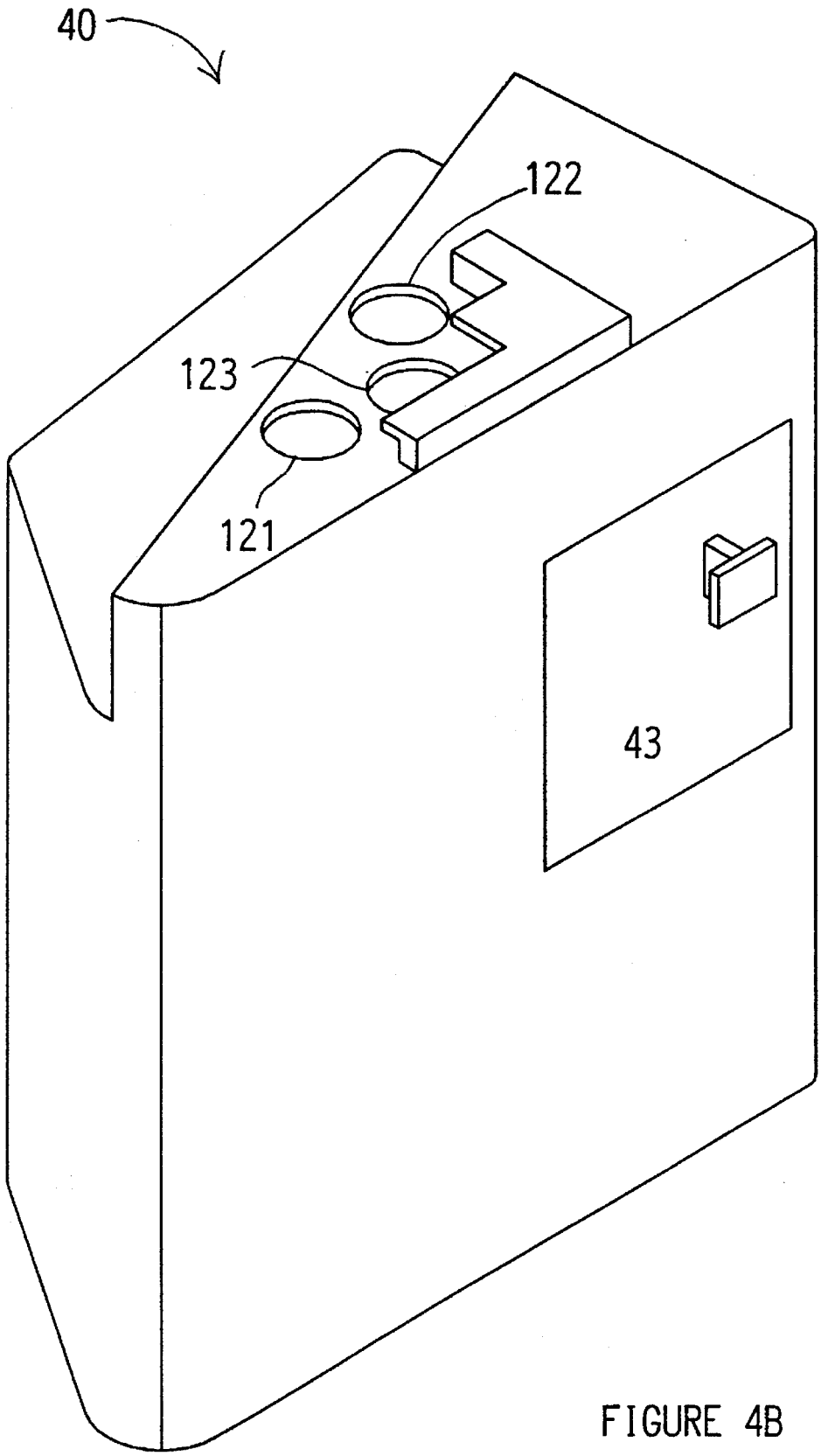

FIGS. 4A and 4B show external views of the main blower module 40 of the toilet ventilation system. FIG. 4A shows the side of the main blower module 40 that is shaped to conform to the shape of the recess in the base of the toilet 10. FIG. 4B shows the exterior side of the main blower module 40. The access door 43 which allows access to the interior of the main blower module 40 and the air filter and fragrance cartridge 140 (FIG. 5) can be seen in FIG. 4B. Air enters the inlet port 123 of the main blower module 40 from the suction port 103 of the central module 30. Air exits the main blower module 40 through the outlet ports 121, 122 and enters the central module 30 through the two inlet ports 101, 102, respectively.

A bracket 44 on the top of the main blower module 40 interlocks with the sliding connector 38 on the left hand side of the central module 30 making a mechanical connection that suspends the main blower module 40. The bracket 44 covers and protects a two-prong male electrical connector 45 (seen in FIG. 5) that matches up with the female electrical connector 34 of the central module 30 when the bracket 44 is slid into the sliding connector 38.

Figure 5:
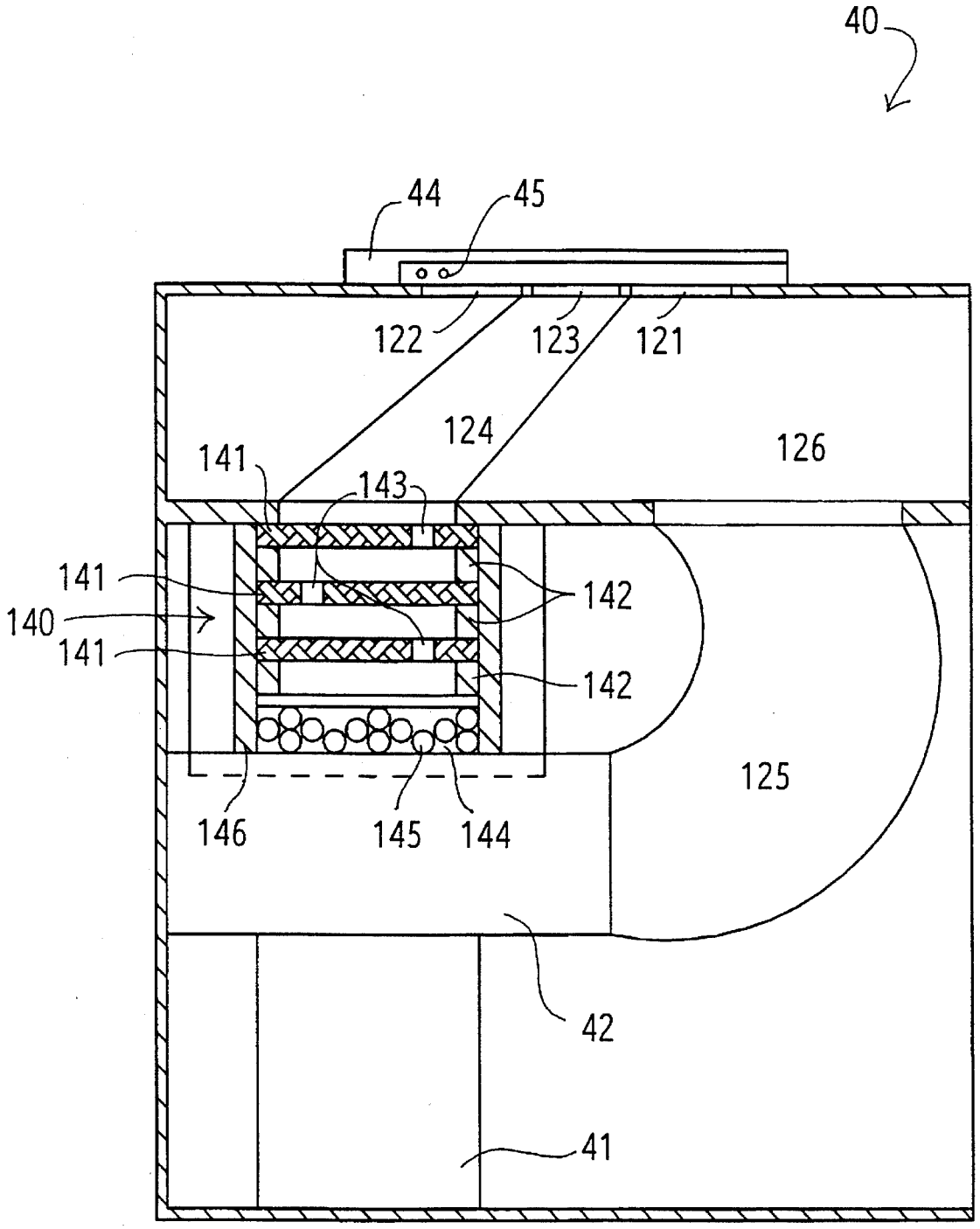
FIG. 5 shows a cutaway view of the main blower module and the filter cartridge.

FIG. 5 is a cutaway view showing the interior of the main blower module 40. Air enters the main blower module 40 through the inlet port 123. Inlet duct 124 directs the incoming air to the air filter and fragrance cartridge 140, then to the suction side of the main blower 42. The main blower 42 is a centrifugal fan or squirrel cage fan which is powered by the main blower motor 41. The air passes through the main blower 42 and exits under pressure through the outlet duct 125. Outlet manifold 126 divides the airflow between the two outlet ports 121, 122.

The air filter and fragrance cartridge 140 contains layers of activated charcoal-containing filter medium 141 that are separated by rings 142. Bypass holes 143 can be added to the filter medium layers 141 to reduce back pressure. Any noxious gasses in the incoming air are removed by the activated charcoal in the filter medium. After it is filtered, the air passes into the fragrance chamber 144 which contains fragrance granules 146. The air picks up the scent of the fragrance granules 146 before it is directed back into the interior space of the toilet bowl. The body of the filter cartridge 146 is preferably made of wire reinforced ducting or other resilient material so that it can be compressed and inserted into the space between the main blower 42 and the inlet duct 124 which is accessible through the access door 43.

Figure 6B:
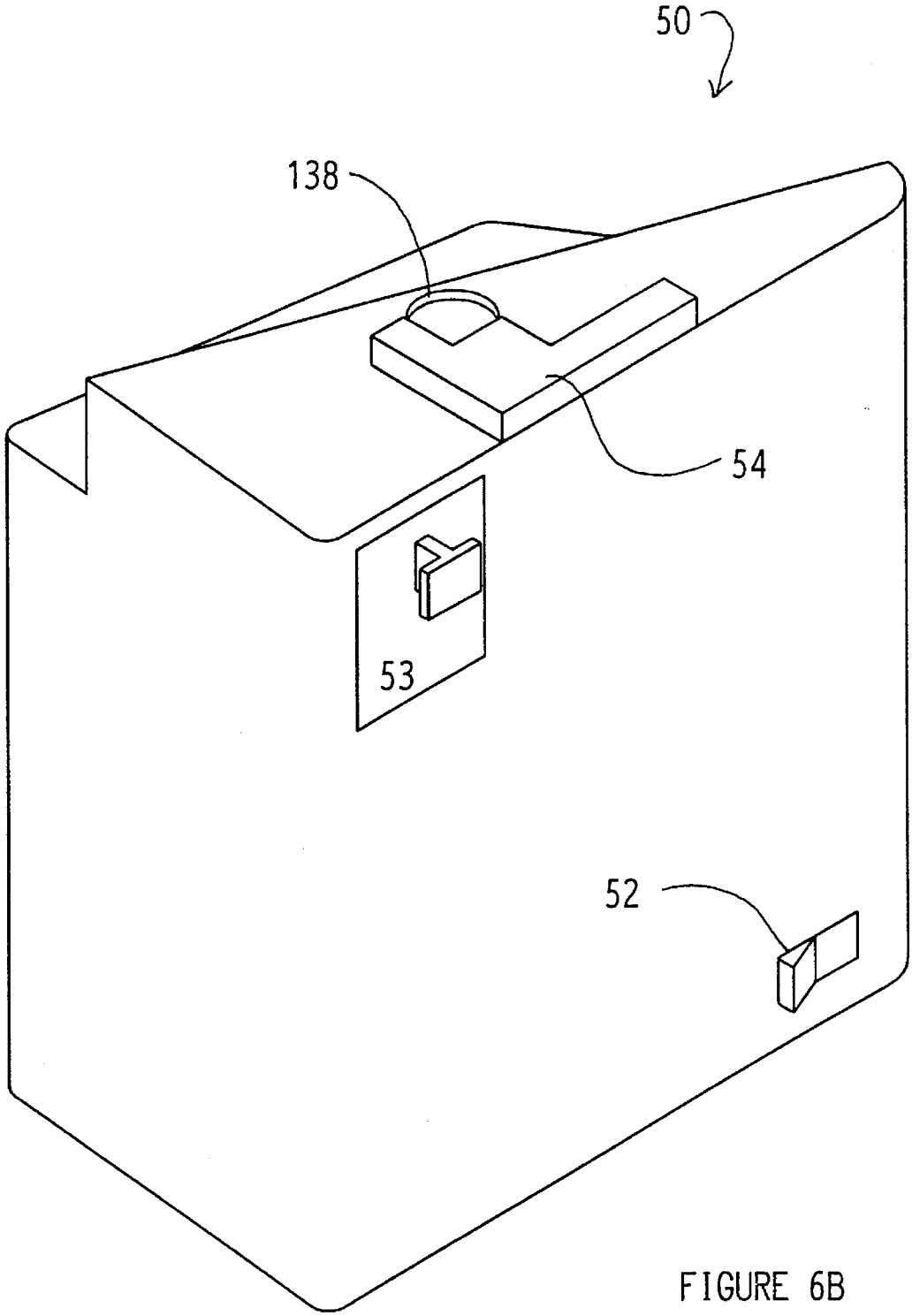

FIGS. 6A and 6B show external views of the heater module 50 of the toilet ventilation system. FIG. 6A shows the side of the heater module 50 that is shaped to conform to the shape of the recess in the base of the toilet 10. FIG. 6B shows the exterior side of the heater module 50. The main power switch 52 and the access door 53 which allows access to the interior of the heater module 50 and the fragrance chamber 130 (FIG. 7) can be seen in FIG. 6B.

A bracket 54 on the top of the heater module 50 interlocks with the sliding connector 39 on the left hand side of the central module 30 making a mechanical connection that suspends the heater module 50. The bracket 54 covers and protects a three-prong male electrical connector 45 (seen in FIG. 7) that matches up with the female electrical connector 35 of the central module 30 when the bracket 54 is slid into the sliding connector 39. Heated air exits the heater module 50 through an outlet port 138 which aligns with the hot air inlet port 108 on the right hand side of the central module 30.

Figure 7:
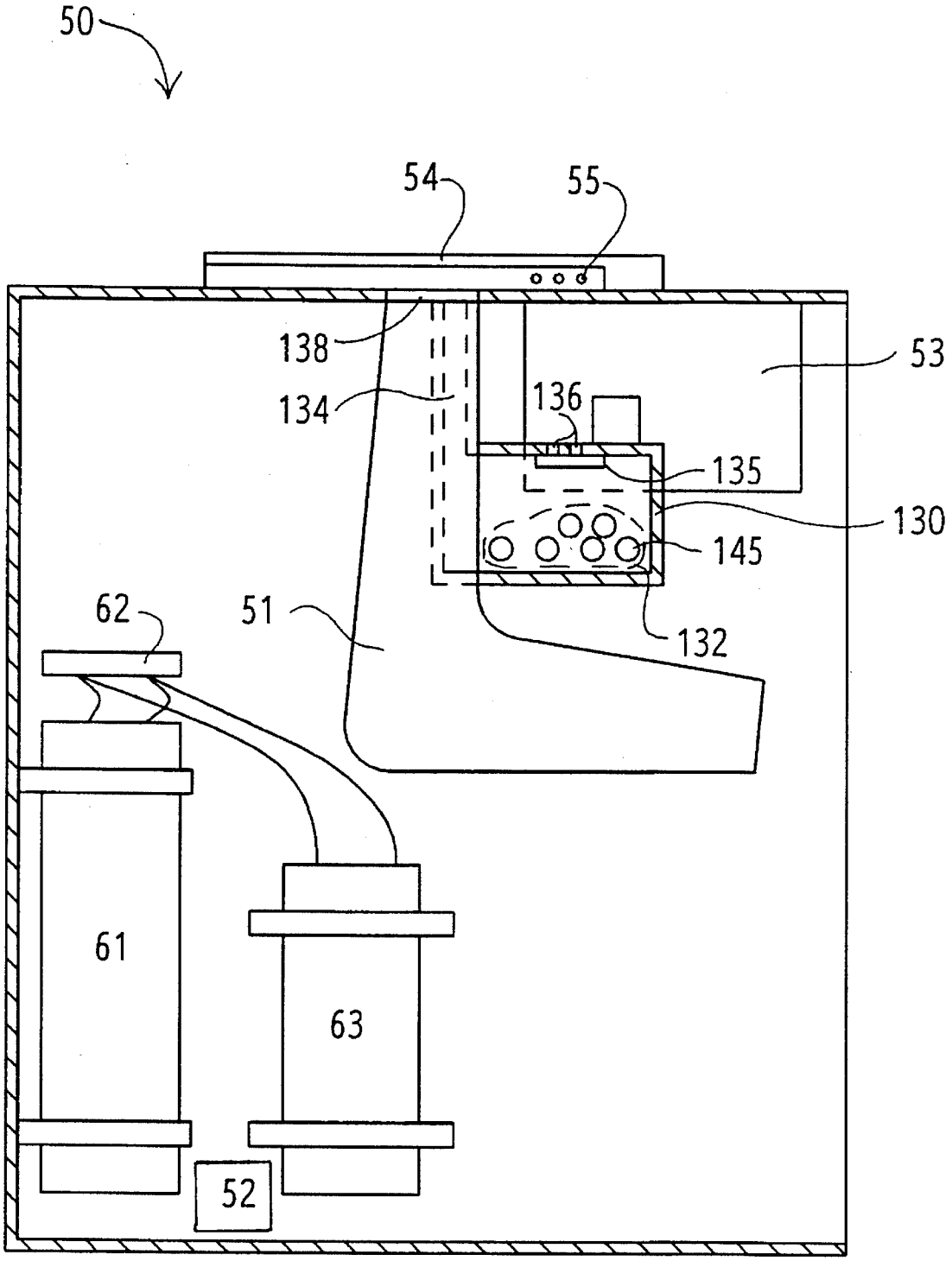
FIG. 7 shows a cutaway view of the heater module.

FIG. 7 is a cutaway view showing the interior of the heater module 50. The heater unit 51 inside of the heater module 50 is made from a readily available 12 volt DC powered hair dryer unit. The heater unit 51 contains a fan, a fan motor and an electrical resistance heater, which are surrounded by an air duct. If it is found to be more economical, the heater unit 51 could also be assembled from separate components. The air duct of the heater unit 51 is connected to outlet port 138 which aligns with the hot air inlet port 108 of the central module 30.

The heater module 50 also contains a fragrance chamber 130 that receives a small sachet 132 of fragrance granules 145. The heated air does not blow directly through the fragrance chamber 130 because, at elevated temperatures, it would extract the fragrance from the granules 145 too quickly. Instead a small tube 134 connects the fragrance chamber 130 to the duct on the heater unit 51. The venturi effect creates a low pressure in the tube 134 which draws cool air through the fragrance chamber 130 entraining the fragrance of the granules 145 into the airstream. A flapper valve 135 in the ventilated cover 136 of the fragrance chamber 130 prevents back flow of air through the fragrance chamber 130.

As can be seen in FIG. 7, the heater module 50 also contains the electrical components necessary for converting 120 volt AC power to 12 volt DC power for operating the system on household current. These components include the transformer 61, rectifier 62, capacitor 63 and the main power switch 52 which are discussed in greater detail below.

Figure 8:
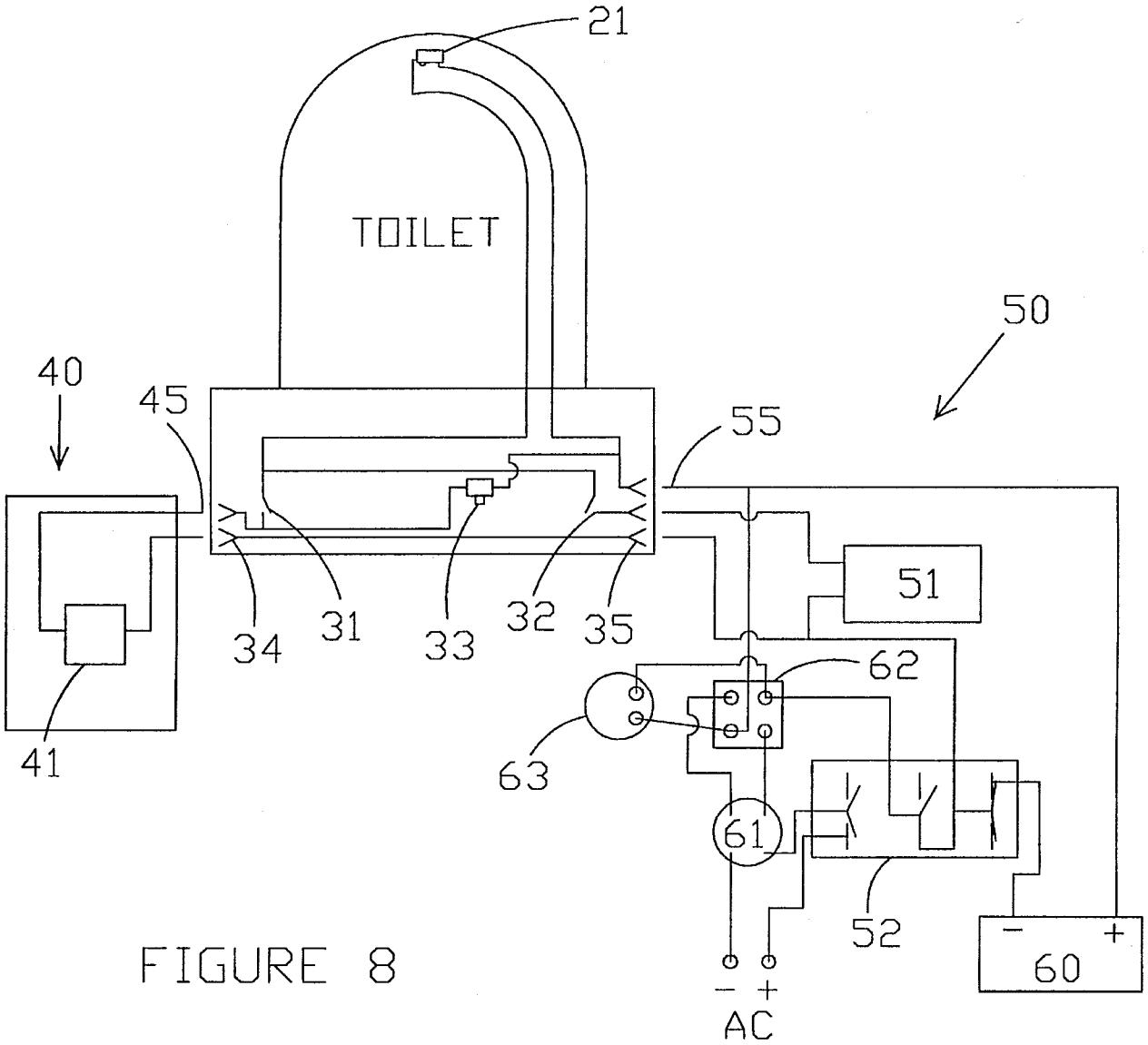
FIG. 8 shows a schematic diagram of the system electrical wiring.

FIG. 8 shows a schematic diagram of the toilet ventilation system's electrical wiring. The system can be operated on battery power or on AC power or on a combination of battery and AC power. An important aspect of this is to provide electrical isolation to the system which will prevent any possible injury to the user whenever the system is connected to AC power. There are two modes of use of the toilet ventilation system. The first draws 110 volt AC power from the standard wall outlet. A transformer, rectifier, and capacitor convert the power from 110 volt AC to 12 volt DC. The second mode uses a 12 volt battery, thereby providing the necessary low voltage DC current to insure safety. In keeping with these modes, the system may be built in three different configurations: (1) having the power cord, transformer, rectifier, and capacitor, (2) having just a battery pack, and (3) being equipped to run either way, having the power cord, transformer, rectifier, capacitor, battery pack, and a switching system for changing from one mode to the other.

OPERATIONAL DESCRIPTION

The toilet ventilation system is easily installed. First, the consumer should remove the existing toilet seat from the toilet 10 by unfastening the bolts which hold the seat on. Then, the cover 36 is lifted off of the central module 30 exposing the bolt holes 37 and the central module 30 is aligned with the bolt holes 37 over the bolt holes in the toilet base. The ventilator module 20 with the integral seat, is bolted into place through the bolt holes 37 in the central module 30 in the same manner as a standard toilet seat and the cover 36 is replaced over the central module 30 to cover the bolts. To complete the assembly, the bracket of the main blower module 40 is slid into the connector on the left hand side of the central module 30 and the heater module 50 is slid into the connector on the right hand side of the central module 30, making a mechanical and electrical connection between the modules.

Figure 9:
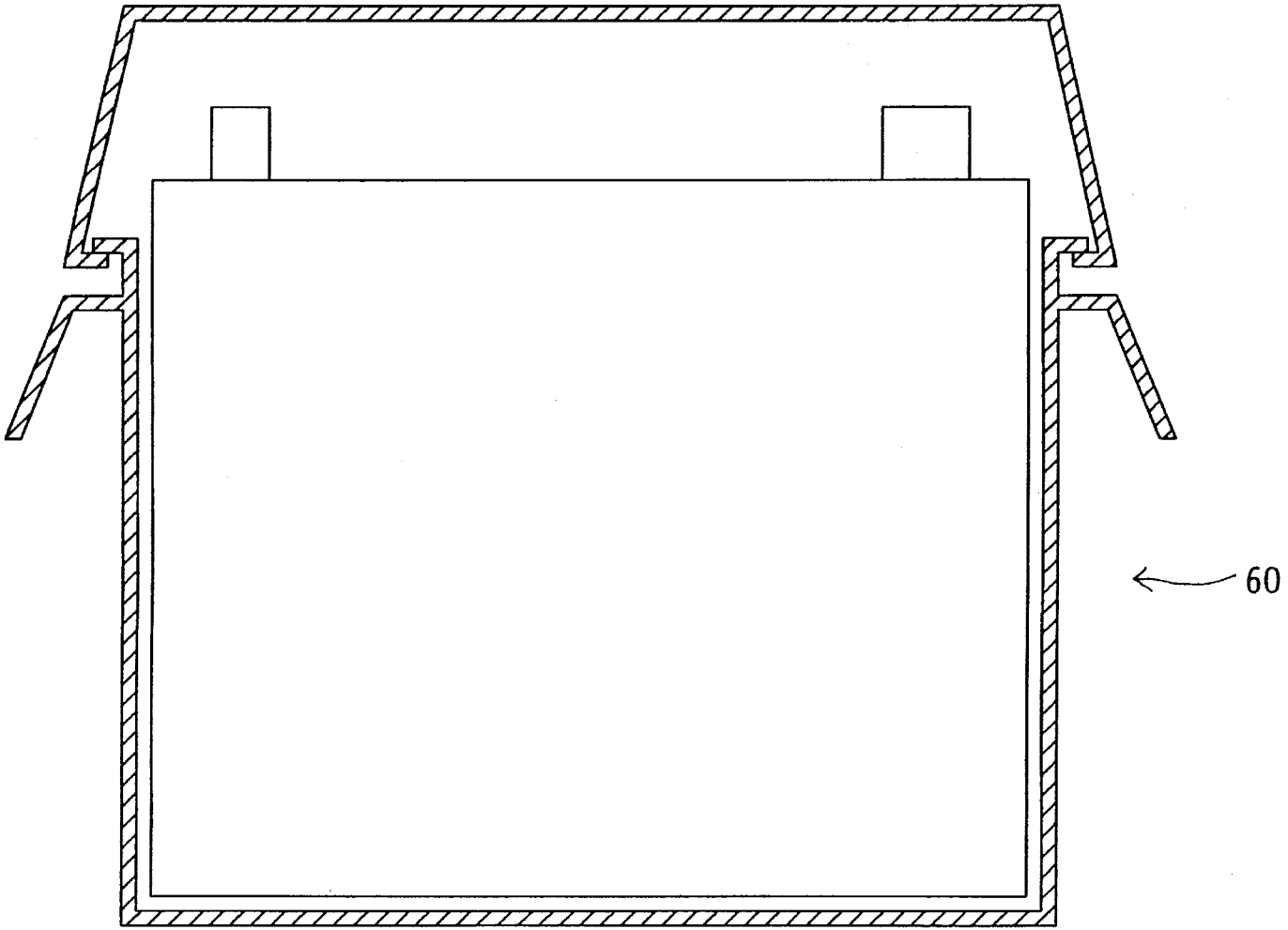
FIG. 9 shows a cutaway view of the optional battery module.

If the system is to be operated on battery mode, the optional battery module 60, shown in FIG. 9, is connected to the system and it is ready for operation. If the system is to be operated on AC power mode, the transformer is plugged into a nearby AC outlet. If the system is to be operated on combination or battery-recharging mode, then both of these steps should be carried out. The main power switch 52 can then be used to switch the system between AC and DC power modes.

The toilet ventilation system operates in three modes: automatic mode, manual mode, and timer mode. To initiate operation of the system in automatic mode, the user need only sit down on the toilet seat. The weight of the user depresses the pressure switch 21, thereby turning on the main blower 42 which recirculates the air through the system. Two rocker switches 31, 32 are provided for operating the system in manual mode. The user can manually turn on either the main blower 42 or the heater unit 51 or both by flipping the switches 31, 32 to the on position. In timer mode, the timer switch 33 can be set to operate the main blower 42 for a specified period of time without supervision. Thus, the system will continue to operate for a preset period of time after the user has departed.

The toilet ventilation system also operates as a room air freshener. To initiate the room air freshener function of the system while the toilet is occupied, the user need only open the sliding shutters 25 on the louvred external vents 26. This allows some of the filtered and scented air to flow out through the external vents 26 into the atmosphere of the bathroom. The room air freshener function can be initiated in two different ways while the toilet is unoccupied. The first way is to open the sliding shutters 25 on the louvred external vents 26, then turn the main blower 42 on in the manual or timed mode. The second way is to lift the toilet seat, which disconnects the ventilator module 20 from the central module 30, then turn the main blower 42 on in the manual or timed mode. This allows the filtered and scented air to flow out into the room unimpeded, without going through the ventilator module 20.

Although the examples given include many specificities, they are intended as illustrative of only some of the possible embodiments of the invention. Other embodiments and modifications will, no doubt, occur to those skilled in the art. For example, while the system has been described in an embodiment meant for retrofit onto an existing toilet, the entire system could be manufactured as original equipment, integrated with the toilet itself. Thus, the examples given should only be interpreted as illustrations of some of the preferred embodiments of the invention, and the full scope of the invention should be determined by the appended claims and their legal equivalents.

I claim:

1. A ventilation system for a toilet which includes a toilet bowl, said ventilation system comprising:

a ventilation module which installs above said toilet bowl, said ventilation module having an upper surface which serves as a toilet seat, said ventilation module adapted to be hingedly attached to said toilet, said ventilation module having a plurality of louvred interior vents beneath said upper surface, said louvred interior vents being in communication with the interior of said toilet bowl, said ventilation module having at least one exhaust vent beneath said upper surface, said at least one exhaust vent being in communication with the interior of said toilet bowl, said ventilation module having a plurality of exterior vents in communication with the space exterior of said toilet bowl, said plurality of exterior vents having a means for opening and closing said plurality of exterior vents, a main blower module housing a main blower and a main blower motor and a filter means for filtering undesirable odors and gasses from air circulated by said main blower and a fragrance means for imparting a fragrance to air circulated by said main blower, said main blower having an inlet side and an outlet side, a heater module housing a heater and a heater blower, said heater blower having an inlet side and an outlet side, and a central module, said central module connecting the outlet side of said main blower to said plurality of louvred interior vents and connecting the inlet side of said main blower to said at least one exhaust vent, said central module also connecting the outlet side of said heater blower to said plurality of louvred interior vents.

2. The ventilation system of claim 1 further comprising a connection means between said ventilation module and said central module for connecting said plurality of louvred interior vents to the outlet side of said main blower when said toilet seat is in a lowered position and for disconnecting said plurality of louvred interior vents from the outlet side of said main blower when said toilet seat is in a raised position.

3. The ventilation system of claim 1 wherein said main blower motor, said heater and said heater blower operate on direct current and said ventilation system further comprises a power source which includes a direct current power source and a transformer means for converting alternating current to direct current and a switching means for alternately connecting said main blower motor, said heater and said heater blower to said direct current power source or to said transformer means.

4. The ventilation system of claim 1 further comprising a switching system, including a pressure switch means mounted to the underside of said ventilation module for activating said main blower means when a weight above a predetermined threshhold weight is exerted on said ventilation module, a first manual switch means for activating said main blower when said first manual switch means is in an on position, a second manual switch means for activating said heater and said heater blower when said second manual switch means is in an on position, and a variable timer switch means for activating said main blower for a variable duration of time.

5. A ventilation system for a toilet which includes a toilet bowl, said ventilation system comprising:

a ventilation module which installs above said toilet bowl, said ventilation module having an upper surface, said ventilation module adapted to be hingedly attached to said toilet, said ventilation module having at least one interior vent beneath said upper surface, said at least one interior vent being in communication with the interior of said toilet bowl, said ventilation module having at least one exhaust vent beneath said upper surface, said at least one exhaust vent being in communication with the interior of said toilet bowl, said ventilation module having at least one external air vent which vents air into the atmosphere of a room occupied by said toilet, said ventilation module having means for opening and closing said at least one external air vent, a main blower means for circulating air through said ventilation system, said main blower comprising a main blower and a main blower motor and a filter means for filtering undesirable odors and gasses from air circulated by said main blower, said main blower having an inlet side and an outlet side, a heater module housing a heater and a heater blower, said heater blower having an inlet side and an outlet side, and a central module, said central module connecting the outlet side of said main blower to said at least one interior vent and connecting the inlet side of said main blower to said at least one exhaust vent, said central module also connecting the outlet side of said heater blower to said at least one interior vent.

6. The ventilation system of claim 5 further comprising a fragrance means for imparting a fragrance to the air circulated by said main blower means.

7. The ventilation system of claim 5 wherein said upper surface of said ventilation module serves as a toilet seat.

8. The ventilation system of claim 5 wherein said ventilation module is attached to a toilet seat such that when said toilet seat is raised above said toilet bowl, said ventilation module is raised with said toilet seat.

9. The ventilation system of claim 5 wherein said at least one external air vent and said at least one interior vent are louvred.

10. The ventilation system of claim 5 further comprising a pressure switch means mounted to the underside of a toilet seat for activating said main blower means when a weight above a predetermined threshhold weight is exerted on said toilet seat.

11. The ventilation system of claim 10 further comprising a manual switch means for activating said main blower means.

12. The ventilation system of claim 10 further comprising a variable timer switch means for activating said main blower means for a variable duration of time.

13. The ventilation system of claim 5 further comprising a connection means between said ventilation module and said central module for connecting said interior vents to the outlet side of said main blower when said toilet seat is in a lowered position and for disconnecting said interior vent from the outlet side of said main blower when said toilet seat is in a raised position.

14. The ventilation system of claim 5 wherein said main blower motor, said heater and said heater blower operate on direct current and said ventilation system further comprises a power source which includes a direct current power source and a transformer means for converting alternating current to direct current and a switching means for alternately connecting said main blower motor, said heater and said heater blower to said direct current power source or to said transformer means.

* * * * *